US009200349B2

(12) United States Patent
Stekly

(10) Patent No.: US 9,200,349 B2
(45) Date of Patent: Dec. 1, 2015

(54) WIRE FOR REFINING MOLTEN METAL AND ASSOCIATED METHOD OF MANUFACTURE

(75) Inventor: Victor Colin Stekly, Cambridge (GB)

(73) Assignee: Injection Alloys Limited, Fowlmere, Royston, Hertfordshire (GB)

( * ) Notice: Subject to any disclaimer, the term of this patent is extended or adjusted under 35 U.S.C. 154(b) by 1263 days.

(21) Appl. No.: 11/814,863

(22) PCT Filed: Jan. 30, 2006

(86) PCT No.: PCT/GB2006/000293

§ 371 (c)(1),
(2), (4) Date: Jun. 17, 2009

(87) PCT Pub. No.: WO2006/079832

PCT Pub. Date: Aug. 3, 2006

(65) Prior Publication Data

US 2009/0293674 A1 Dec. 3, 2009

(30) Foreign Application Priority Data

Jan. 28, 2005 (GB) ..... 0501775.1

(51) Int. Cl.

| | |
|---|---|
| ***C21C 7/00*** | (2006.01) |
| ***C22C 1/06*** | (2006.01) |
| ***B21C 1/00*** | (2006.01) |
| ***B21C 37/04*** | (2006.01) |

(52) U.S. Cl.

CPC . *C22C 1/06* (2013.01); *B21C 1/003* (2013.01); *B21C 37/045* (2013.01); *C21C 7/0006* (2013.01); *C21C 7/0056* (2013.01)

(58) Field of Classification Search

CPC ..... C21C 7/0006; C21C 7/0056; C21C 7/06; B21C 1/003; B21C 37/045

USPC ..... 75/703, 330

See application file for complete search history.

(56) References Cited

U.S. PATENT DOCUMENTS

| | | | |
|---|---|---|---|
| 3,993,477 | A | 11/1976 | Hess et al. |
| 4,134,196 | A | 1/1979 | Yamaji et al. |
| 4,308,056 | A | 12/1981 | Guarino et al. |
| 4,584,169 | A | 4/1986 | Werner et al. |
| 4,711,663 | A | 12/1987 | Ferrari |

(Continued)

FOREIGN PATENT DOCUMENTS

| | | |
|---|---|---|
| CA | 1275616 | 10/1990 |
| CN | 1084894 A | 4/1994 |

(Continued)

OTHER PUBLICATIONS

Machine translation of DE19916234A1, Sep. 2000.*

(Continued)

*Primary Examiner* — Jie Yang

(74) *Attorney, Agent, or Firm* — Curatolo Sidoti Co., LPA; Joseph G. Curatolo; Salvatore A. Sidoti

(57) ABSTRACT

A molten metal refining wire (11) comprises a metal sheath (12) encapsulating a core (14) of refining material, such as pure calcium powder, wherein the core (14) is sealed within the sheath (12) in a fluid-tight manner. A corresponding method of manufacturing the molten metal refining wire (11) is disclosed, as well as a method of refining molten metal by injecting the refining wire (11) into the molten metal.

28 Claims, 1 Drawing Sheet

(56) References Cited

U.S. PATENT DOCUMENTS

| | | | | |
|---|---|---|---|---|
| 4,738,714 | A | | 4/1988 | De Zeeuw |
| 4,765,599 | A | | 8/1988 | Ferrari |
| 4,832,742 | A | | 5/1989 | Onotani |
| 4,897,114 | A | | 1/1990 | Neuer |
| 5,087,290 | A | * | 2/1992 | Wolfsgruber et al. ..... 75/303 |
| 5,192,016 | A | * | 3/1993 | Araki et al. ..... 228/147 |
| 5,474,736 | A | | 12/1995 | Araki et al. |

FOREIGN PATENT DOCUMENTS

| | | | | |
|---|---|---|---|---|
| DE | 19916234 | A1 | * | 9/2000 |
| EP | 0003370 | A | | 8/1979 |
| EP | 0158693 | | | 10/1985 |
| EP | 0234623 | | | 9/1987 |
| EP | 0277664 | A1 | | 8/1988 |
| FR | 2433584 | A1 | | 3/1980 |
| GB | 2139924 | A | | 11/1984 |
| JP | 53040616 | A | * | 4/1978 |
| JP | 58031259 | | | 8/1981 |
| JP | 61-154777 | A | | 7/1986 |
| JP | 2-70398 | A | | 3/1990 |
| JP | 03207598 | A | | 9/1991 |
| JP | 5031595 | | | 2/1993 |
| JP | 6190591 | A | | 7/1994 |
| JP | 6218579 | | | 8/1994 |
| JP | 7316630 | | | 12/1995 |
| JP | 8118073 | | | 5/1996 |
| JP | 200087128 | | | 3/2000 |
| JP | 2004344891 | | | 12/2004 |
| RU | 2118379 | C1 | | 8/1998 |
| RU | 2218422 | C2 | * | 12/2003 |

OTHER PUBLICATIONS

Bingyang, Zhang et al, Study on New Technology of Wire Feeding, Journal of Iron & Steel Research, May 1989, p. 1, vol. 1, No. 2.

"Patents Act 1977: Search Report," United Kingdom Patent Office, GB Application No. 0501775.1, Jun. 3, 2005, p. 1.

PCT: International Preliminary Report on Patentability of PCT/GB2006/000293: Jul. 31, 2007.

PCT: Written Opinion of the International Searching Authority of PCT/GB2006/000293; Jul. 28, 2007.

* cited by examiner

WIRE FOR REFINING MOLTEN METAL AND ASSOCIATED METHOD OF MANUFACTURE

TECHNICAL FIELD

This invention relates to wire for refining molten metal with additives, such as metallic material and/or minerals, and an associated method of manufacturing such wire.

CROSS-REFERENCE TO RELATED APPLICATIONS

This application is a National Phase Application filed pursuant to 35 U.S.C. §371 claiming priority to PCT/GB2006/079832 A1, entitled "WIRE FOR REFINING MOLTEN METAL AND ASSOCIATED METHOD OF MANUFACTURE," filed on Aug. 3, 2006, which is a Patent Cooperation Treaty Application of United Kingdom Patent Application No. GB 0501775.1, entitled "WIRE FOR REFINING MOLTEN METAL AND ASSOCIATED METHOD OF MANUFACTURE," filed on Jan. 28, 2005.

BACKGROUND

Prior to casting a molten metal, such as molten steel, refining wires can be injected into the molten metal vessels such as a ladle, pot or continuous casting tundish, to provide the metal with improved characteristics. The purpose of the refining wire is to inject refining materials, such as metals and/or minerals, encapsulated in the sheath of the wire into the molten metal in accurate quantities and in a controller manner, when the refining materials display either a high affinity to oxygen, or a low melting and/or vapor point, or a high vapor pressure, or a low solubility or law density compared to the molten metal, or a combination of these factors. In this regard, it is important to achieve a high percentage of recovery of the refining material defined as the ratio of the injected material quantity remaining into the molten metal divided by the total material quantity injected.

In a known method manufacturing a refining wire, a steel strip is rolled to form a U-shaped section that is filled with refining material in powered form. The two longitudinal edges of the U-shaped strip section, which have been prefolded to that effect, are then hooked together. In this manner, a refining wire is formed with the steel sheath encapsulating a core of refining material.

Another method of manufacturing a refining wire is the same as above with the exception that the refining material is introduced into the U-shaped section as a solid extruded wire.

Refining wires produced by these known methods usually have a sheath thickness in the range of 0.2 mm to 0.6 mm due to the manufacturing and product constraints. As a result, the wire can be deformed easily by the high pressure of the feeder pinch rolls used to inject the wire through a guide tube into the molten metal vessel, thereby requiring guide tubes with comparatively large inner diameters which are detrimental to guiding the refining wire accurately into the vessel.

Sometimes also, the refining wire is not sufficiently rigid to penetrate a solidified surface of slag floating on the surface of the molten metal, such as molten steel, in the vessel.

Further, the hook-type closure for the steel sheath of the wires discussed above does not allow for the deep rolling or drawing of such wires down to much smaller diameters, in which case, the core can include excessive and undesirable amounts of air which, during the refining process, is detrimental to the quality fo the molten metal as well as the recovery of the core material. Moreover, the refining material can interact with the components of the air or other materials, such as moisture or oxidizing agents, thus reducing the shelf life of the wire.

It is an object of the present invention to provide a refining wire that overcomes, or at least substantially reduces, the disadvantages associated with the known refining wires discussed above.

It is another object of the invention to provide a refining wire and associate method of manufacture, with a sheath thickness which is larger than those of the known refining wires discussed above, resulting in improved manufacturing techniques for refining molten metals, particularly molten steel.

SUMMARY

Accordingly, a first aspect of the invention provides a molten metal refining wire comprising a metal sheath encapsulating a core of refining material, wherein the core is sealed within the sheath in a fluid-tight manner.

Preferably, the wire has been deep rolled or drawn to a smaller diameter.

The sheath may be made of any suitable metallic material. However, when the refining wire is used for refining molten steel, the sheath is preferably a low carbon, low silicon steel.

The encapsulated core of refining material may, again, be any suitable material for refining molten metal, for example molten steel, such materials including, inter alia, pure calcium or calcium, aluminum or nickel metal or any combination thereof, a calcium-silicon alloy (CaSi), a ferro-titanium alloy (FeTi), a ferro-boron alloy (FeB), or any combination thereof.

A second aspect of the invention resides in a method of manufacturing a molten metal refining wire comprising a metallic sheath encapsulating a core of refining material, wherein the core is encapsulated within the sheath in a fluid-tight manner.

A third aspect of the invention resides in a method of manufacturing a molten metal refining wire comprising a metallic sheath encapsulating a core of refining material, the method comprising forming a metal strip into a sheath with the refining material encapsulated therein, and sealing together, preferably by welding, the longitudinal edges of the so-formed sheath in a fluid-tight manner.

In either aspect of the inventive method defined above, the sheath may again be made of any suitable metallic material but when the refining wire is used for refining molten steel, the sheath is preferable a low carbon-low silicon steel.

Also, the edges of the sheath are preferably butt welded together.

The encapsulated core of refining material may, again, be any suitable material for refining molten metal, for example molten steel, such materials including, inter alia, pure calcium or calcium, aluminum or nickel metal or any combination thereof, a calcium-silicon alloy (CaSi), a ferro-titanium alloy (FeTi), a ferro-boron alloy (FeB), or any combination thereof.

Thus, because the refining wire sheath is sealed, such as welded, preferably butt welded, to encapsulate the refining material of the core in a fluid-tight manner, sheath thicknesses of up to 2.0 mm can achieved, as opposed to a maximum sheath thickness of 0.6 mm for the previously known refining wires.

In order to reduce oxygen, air or other deleterious gases remaining in the sheath of the so-formed wire, the wire can be deep rolled or drawn to a smaller diameter, thereby expelling such gases from the wire, without detriment to the integrity thereof, whilst also tending to the close the sheath around the core more tightly. In this manner, core refining material apparent density ratios over 95% of the theoretical solid core equivalent, can be achieved.

Further and due to the thicker sheaths, damage to the wire, which might otherwise occur with the known refining wires through the high-pressure of the pinch rolls thrusting the wire through the guide tubes into the molten metal vessel, is diminished, while the wire, particularly when having higher sheath thicknesses, is sufficiently rigid to the penetrate the solidified surface of the slag floating on the surface of the molten metal in the vessel.

Further, the wire does not tend to melt high in the vessels before reaching the bottom thereof, as do the known refining wires, thereby releasing the refining material under high static pressure, far away from the oxygen present in the slag and atmosphere above, and increasing the floatation time of law density refining materials, these all being favorable factors for achieving a high recover.

A forth aspect of the invention provides a method of refining molten metal, comprising injecting into molten metal a refining wire in accordance with the first aspect of the invention or a wire manufactured in accordance with the second or third aspect of the invention defined above.

BRIEF DESCRIPTION OF THE DRAWINGS

In order that the invention may be more fully understood, a refining wire in accordance therewith will now be described by way of example and by way of comparison with a prior art refining wire, in accordance with the accompanying Examples and drawings in which.

DETAILED DESCRIPTION

Figure 1:
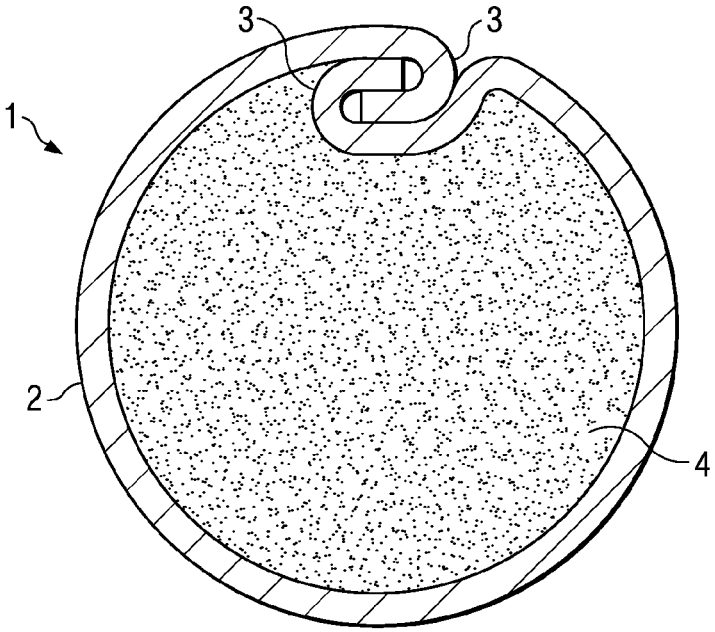
FIG. 1 is a cross-section of a known wire for refining molten steel.

Referring firstly to the prior art refining wire, as indicated generally at 1 in FIG. 1, there comprises a steel sheath 2 which has been formed from a steel strip whose longitudinal edges have been bent into the form of a hook 3. The steel strip will have also been bent into a U-shape for receiving therein a powered refining material 4. the two pre-folded edges 3 are then hooked together, so that the refining material 4 is encapsulated within the sheath 2 as a core.

As discussed above, due tot the bulkiness of the hook-type closure and because that closure is not properly sealed, that is to say, it is not fluid-tight, deep rolling or drawing of the wire 1 is not possible and, also, air can be present within the refining material 4. This undesirable oxygen is detrimental to the quality of the molten steel as the refining wire 1 is injected hereinto, as well as to the recovery of the core material 4.

Figure 2:
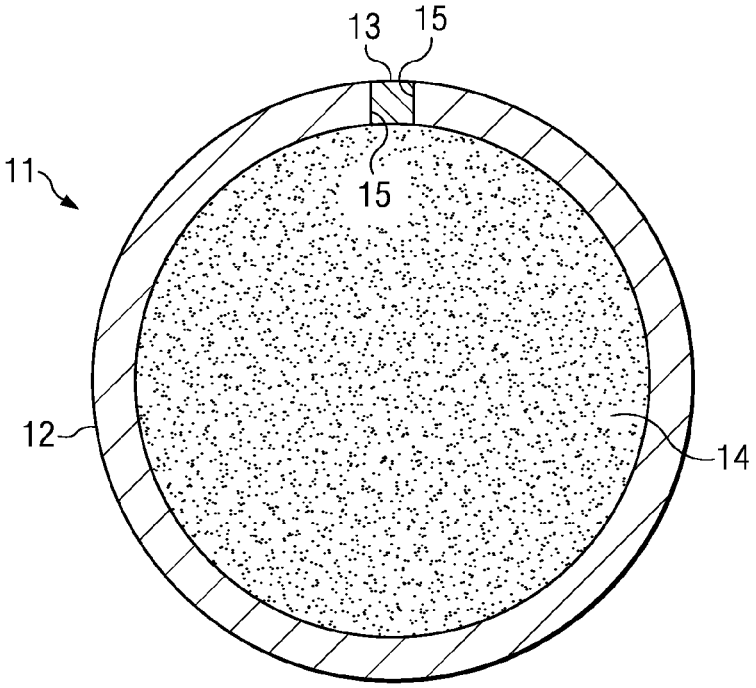
FIG. 2 is a section of a wire for refining molten steel, in accordance with the invention.

Referring now to the FIG. 2 of the accompanying drawings, here is shown a molten metal refining, dosing wire 11 in accordance with the invention, wherein the steel sheath 12 has been formed from a strip of steel formed into a generally U-shape into which the refining material of the core has been provided.

In contrast to the prior art refining wire 1 discussed above in relation to FIG. 1, the confronting or abutting longitudinal edges 15 of the sheath are sealed together in a fluid type manner by welding. Thus, this so-formed welded seam 13 encapsulates the core 14 of the wire 11 within the sheath 12 in a sealed, fluid-tight manner, thus preventing any undesirable oxygen or other gas or material from entering the interior of the sheath 12 during a molten metal refining process.

Also, any air, oxygen or other gas present in the sheath 12 can be reduced by expelling it from the sheath interior if the wire 11 is deep rolled or drawn down in diameter. This also tends to close the sheath 12 more tightly around the core 14.

The following Examples are provided to illustrate the compositions and dimensions of preferred molten steel refining wires in accordance with the invention, where the steel from which the sheath is made is SAE 1006 steel or its equivalent, the core material is powered pure calcium powder and the outside diameter of each wire is 9.0 mm.

EXAMPLES

| Sheath Thickness | Weight of Core Material/Meter of Wire | Apparent Density Compared to Solid Calcium Core Equivalent |
|---|---|---|
| 1.0 mm | 58 grms/meter | 97% |
| 1.0 mm | 43 grms/meter | 97% |

Deep rolling or drawing of the wires may be necessary to provide smaller diameter wires, in dependence upon operating conditions of the refining process, while also tending to the close the sheaths more tightly around the wire cores.

Thus, it can be seen that the invention provides refining wires which improve metal refining techniques, in that, inter alia, they reduce impurities being injected into molten metals, while retaining their overall integrity, particularly during their being fed to the molten metal vessel and their penetration into the molten metal through the slag floating on the molten metal surface.

Also because the sheaths are sealed and have regular, continuous, generally smooth circumferences, they can be readily deep rolled or drawn into smaller diameters without detriment tot heir integrity, while also expelling air, oxygen or any other undesirable gas from the sheath interiors.

Further, deep rolling or drawing of the refining wires to smaller diameters can provide for a core material keeping an apparent density compression ratio of over 95% of the theoretical solid core equivalent.

What is claimed is:

1. A method of manufacturing a molten metal refining wire comprising:

forming a metallic sheath into a generally U-shape;

introducing refining material in powdered form into the metallic sheath;

forming the metallic sheath so as to encapsulate the refining material into a core with longitudinal edges of the sheath abutting each other;

welding the longitudinal edges of the metallic sheath so as to seal them in a fluid-tight manner, whereby undesirable oxygen or other gas or material is prevented from entering the interior of the sheath;

reducing a diameter of the metallic sheath by one or more of a deep rolling or a drawing down process so as to increase the apparent density ratio of the refining material in the core to over 95% of the theoretical solid core equivalent, whereby oxygen, or other deleterious materials remaining in the metallic sheath are minimized, and wherein the thickness of the sheath is greater than 0.6 mm.

2. The method as claimed in claim 1, wherein the surface of the metallic sheath is continuous and generally smooth.

3. The method as claimed in claim 1, wherein the metallic sheath comprises steel.

4. The method as claimed in claim 3, wherein the steel is a low carbon, low silicon steel.

5. The method as claimed in claim 1, wherein the core comprises substantially pure calcium.

6. The method as claimed in claim 1, wherein the core comprises calcium, aluminum or nickel metal or any combination thereof.

7. The method as claimed in claim 1, wherein the core comprises a calcium-silicon alloy, a ferro-titanium alloy, a ferro-boron alloy or any combination thereof.

8. The method as claimed in claim 1, wherein the sheath thickness is up to 2.0 mm.

9. A molten metal refining wire produced by a process comprising:

forming a metallic sheath into a generally U-shape;

introducing refining material in powdered form into the metallic sheath;

forming the metallic sheath so as to encapsulate the refining material into a core consisting of the powdered refining material with longitudinal edges of the sheath abutting each other;

welding the longitudinal edges of the metallic sheath so as to seal them in a fluid-tight manner, whereby undesirable oxygen or other gas or material is prevented from entering the interior of the sheath;

reducing a diameter of the metallic sheath by one or more of a deep rolling or a drawing down process to produce a finished molten metal refining wire having an apparent density ratio of the refining material in the core to over 95% of the theoretical solid core equivalent, whereby oxygen, or other deleterious materials remaining in the sheath are minimized, wherein the thickness of the sheath after the deep rolling or a drawing down process is greater than 0.6 mm and the refining material is a material selected from the group consisting of substantially pure calcium and a calcium-silicon alloy.

10. A method of refining molten metal comprising:

injecting a refining wire into molten metal;

wherein the refining wire is produced by:

forming a metallic sheath into a generally U-shape;

introducing a refining material in powdered form into the metallic sheath forming the metallic sheath so as to encapsulate the refining material into a core with longitudinal edges of the sheath abutting each other;

welding the longitudinal edges of the metallic sheath so as to seal them in a fluid-tight manner, whereby undesirable oxygen or other gas or material is prevented from entering the interior of the sheath; and reducing a diameter of the metallic sheath by one or more of a deep rolling or a drawing down process so as to increase the apparent density ratio of the refining material in the core to over 95% of the theoretical solid core equivalent, whereby oxygen, or other deleterious materials remaining in the sheath are minimized, and wherein the thickness of the sheath is greater than 0.6 mm.

11. The method as claimed in claim 10, wherein the refining wire is injected into the molten metal via a guide tube.

12. The method as claimed in claim 10, wherein the refining wire is injected into the molten metal using pinch rolls.

13. The method as claimed in claim 12, wherein the refining wire is caused to penetrate any slag floating on the surface of the molten metal.

14. A molten metal refining wire comprising a drawn or deep rolled metal sheath encapsulating a core consisting of refining material, wherein the core is sealed within the sheath in a fluid-tight manner, wherein the thickness of the sheath after drawing or rolling of the molten metal refining wire is greater than 0.6 mm, the core material apparent density ratio is over 95% of the theoretical solid core equivalent and the core refining material is a material selected from the group consisting of substantially pure powdered calcium and a powdered calcium-silicon alloy.

15. The molten metal refining wire as claimed in claim 14, wherein the sheath thickness is greater than 0.6 mm and up to 2.0 mm.

16. The molten metal refining wire as claimed in claim 14, wherein the metal sheath comprises steel.

17. The molten metal refining wire as claimed in claim 16, wherein the steel is a low carbon, low silicon steel.

18. A molten metal refining wire comprising a drawn or deep rolled metal sheath encapsulating a core consisting of refining material, the core being sealed within the sheath in a fluid-tight manner, wherein the metal sheath is made of steel, the core refining material is powdered pure calcium powder and the outside diameter of the wire is 9.0 mm, wherein the thickness of the sheath after drawing or rolling of the molten metal refining wire is 1.0 mm, the wire comprises 58 g of core material per meter of wire and the core material apparent density ratio is 97% of the theoretical solid core equivalent.

19. A molten metal refining wire comprising a drawn or deep rolled metal sheath encapsulating a core consisting of refining material, the core being sealed within the sheath in a fluid-tight manner, wherein the metal sheath is made of steel, the core refining material is powdered pure calcium powder and the outside diameter of the wire is 9.0 mm, wherein the thickness of the sheath thickness after drawing or rolling of the molten metal refining wire is 1.5 mm, the wire comprises 43 g of core material per meter of wire and the core material apparent density ratio is 97% of the theoretical solid core equivalent.

20. A molten metal refining wire comprising:

a core consisting of a refining material comprised of material selected from the group consisting of substantially pure calcium powder and a calcium-silicon alloy powder;

a metal sheath encapsulating the core of refining material in a fluid-tight manner to provide an encapsulated core;

wherein the thickness of the metal sheath of the molten metal refining wire is greater than 0.6 mm after the sheath has been rolled or drawn to a final diameter of the molten metal refining wire; and wherein an apparent density ratio of the encapsulated core is over 95% of a theoretical solid core equivalent.

21. A molten metal refining wire produced by a process comprising:

forming a metallic sheath into a generally U-shape;

introducing refining material in powdered form into the metallic sheath;

forming the metallic sheath so as to encapsulate the refining material into a core with longitudinal edges of the sheath abutting each other, whereby undesirable oxygen or other gas or material is prevented from entering the interior of the sheath;

welding the longitudinal edges of the metallic sheath so as to seal them in a fluid-tight manner;

reducing a diameter of the metallic sheath by one or more of a deep rolling or a drawing down process so as to increase the apparent density ratio of the refining material in the core to over 95% of the theoretical solid core equivalent, whereby oxygen, or other deleterious materials remaining in the sheath are minimized, wherein the thickness of the sheath is greater than 0.6 mm and the refining material is a material selected from the group consisting of substantially pure calcium, a calcium-silicon alloy and mixtures thereof.

22. A molten metal refining wire comprising a metal sheath encapsulating a core of refining material, wherein the core is sealed within the sheath in a fluid-tight manner, wherein the thickness of the sheath is greater than 0.6 mm, the core material apparent density ratio is over 95% of the theoretical solid core equivalent and the core refining material is a material selected from the group consisting of substantially pure calcium, a calcium-silicon alloy and mixtures thereof.

23. The molten metal refining wire as claimed in claim 22, wherein the sheath thickness is greater than 0.6 mm and up to 2.0 mm.

24. The molten metal refining wire as claimed in claim 22, wherein the metal sheath comprises steel.

25. The molten metal refining wire as claimed in claim 24, wherein the steel is a low carbon, low silicon steel.

26. A molten metal refining wire comprising:

a core of refining material comprised of material selected from the group consisting of substantially pure calcium, a calcium-silicon alloy and mixtures thereof;

a metal sheath encapsulating the core of refining material in a fluid-tight manner to provide an encapsulated core;

wherein a thickness of the metal sheath is greater than 0.6 mm; and wherein an apparent density ratio of the encapsulated core is over 95% of a theoretical solid core equivalent.

27. The molten metal refining wire as claimed in claim 22, wherein the metal sheath is made of steel and the core refining material is a material selected from the group consisting of substantially pure powdered calcium, a powdered calcium-silicon alloy and mixtures thereof, wherein the outside diameter of the wire is 9.0 mm, the thickness of the sheath after drawing or rolling of the molten metal refining wire is 1.0 mm, the wire comprises 58 g of core material per meter of wire and the core material apparent density ratio is 97% of the theoretical solid core equivalent.

28. The molten metal refining wire as claimed in claim 22, wherein the metal sheath is made of steel and the core refining material is a material selected from the group consisting of substantially pure powdered calcium, a powdered calcium-silicon alloy and mixtures thereof, wherein the outside diameter of the wire is 9.0 mm, the thickness of the sheath after drawing or rolling of the molten metal refining wire is 1.5 mm, the wire comprises 43 g of core material per meter of wire and the core material apparent density ratio is 97% of the theoretical solid core equivalent.

* * * * *